United States Patent [19]

Willi

[11] 4,021,053

[45] May 3, 1977

[54] DEVICE PROVIDING IMPROVED SUPPORT OF THE LOWER LEG OF A SKIER

[76] Inventor: Hans Anton Willi, Gassa Suro 25, Domat, Ems, Switzerland, 7013

[22] Filed: Sept. 30, 1975

[21] Appl. No.: 618,251

[30] Foreign Application Priority Data

Oct. 1, 1974 Switzerland ..... 13232/74

[52] U.S. Cl. ..... 280/11.36; 36/89; 36/125

[51] Int. Cl.[2] ..... A63C 11/00

[58] Field of Search ..... 280/11.36, 11.35 K, 280/11.35 R, 11.37 E, 618, 611, 637, 636; 36/2.5 AL, 2.5 N, 2.5 AA, 2.5 AB, 117, 118, 120, 121, 122, 125, 89

[56] References Cited

UNITED STATES PATENTS

| | | | |
|---|---|---|---|
| 3,895,817 | 7/1975 | Gertsch | 280/618 |

FOREIGN PATENTS OR APPLICATIONS

| | | | |
|---|---|---|---|
| 296,843 | 2/1972 | Austria | 280/11.36 |
| 919,975 | 12/1946 | France | 280/11.36 |
| 2,224,057 | 12/1972 | Germany | 280/618 |
| 857,006 | 11/1952 | Germany | 280/11.36 |
| 623,574 | 12/1935 | Germany | 280/11.36 |
| 484,643 | 3/1970 | Switzerland | 36/2.5 AL |
| 471,551 | 6/1969 | Switzerland | 36/2.5 AL |

*Primary Examiner*—Joseph F. Peters, Jr.
*Assistant Examiner*—Milton L. Smith
*Attorney, Agent, or Firm*—Larson, Taylor and Hinds

[57] ABSTRACT

A support for the lower leg of a skier comprises an arm pivotally connected at one end to the upper part of the lower leg and at the other end to the ski through jaws gripping the ski-boot and firmly connected with the ski by the pressure of the boot sole thereon. Pivoting of the arm is controlled by a double acting resilient device which is adjustable to vary the force on the arm and to vary the neutral position of the arm.

6 Claims, 2 Drawing Figures

DEVICE PROVIDING IMPROVED SUPPORT OF THE LOWER LEG OF A SKIER

FIELD OF THE INVENTION

The present invention relates to a device providing improved support of the lower leg of a skier on a ski and having a support which grasps around at least a part of the upper part of the lower leg.

BACKGROUND OF THE INVENTION

Ever higher performances in skiing make ever greater demands on skiing equipment, especially on ski boots. Above all, measures should be taken which reduce the stressing of the feet and legs of the skier in order largely to avoid fatigue phenomena which are frequently the cause of fractures.

On the other hand, these measures should render it possible for the skier to exert greater influence upon the skis. To realise these requirements, stiffer and higher ski boots are designed which, while they permit the skier to exert considerable influence upon the ski, also involve the danger of fractures of the tibia and fibula and what are called boot-upper edge fractures. Especially in deep-snow skiing, modern skiing techniques often require extreme relieving of the forward ski parts. In order to achieve this, the ski boots are built with even higher uppers. Apart from the fact that thus the calf muscles are constrained, the mobility of the tibia and fibula is greatly limited. The designers of ski boots are in a dilemma because, on the one hand, the ski boot should be of rigid formation in order to transmit the forces better to the ski, and on the other hand, it should be flexible enough to permit anatomically natural movement of the legs.

DESCRIPTION OF THE PRIOR ART

Swiss Pat. No. 484,643 describes ski boots which have a prolonged tongue provided with a steel insert and an elastic strip fitted to the upper end which grasps round the lower leg. This arrangement has the disadvantage that the supporting forces are transmitted to the ski through the ski boots. It appears that ski boots, which in any case are already expected to satisfy too many contradictory requirements cannot fully fulfil these requirements. Controlled action of the support force deriving from the lower leg upon the ski is therefore not possible by this design. It is also virtually impossible to bring the tongue into such a position that it assumes the correct position and receives the required stress even when the knee is bent.

Swiss Pat. No. 471, 551describe a safety boot which is provided with a rigid upper assembly enclosing the lower leg. This assembly extends at least to the mid-length of the lower leg and is connected so as to resist buckling at least in the region of the two sides which are subjected to buckling forces on tilting of the ski.

This concept has the same disadvantage that, in addition to the usual functions of a ski boot, still further demands must be met. This ski boot offers good protection to the lower leg, but this is offset by the described disadvantages of ski boots with long uppers. It would appear to be impossible to build a ski boot with a strength suitable for every leg, every muscle system and all skiing conditions, so that in only few cases does the boot have just the correct fit.

Moreover the effect is also rendered dubious by defective adjustment which can be ascertained only after purchase and use have taken place. If the joint in the ski boot is too soft, while free mobility of the fibula is guaranteed, good influence upon the ski is not however available. If the joint is too hard, there is danger of injury to the knee and good freedom of movement of the fibula is no longer ensured, leading to serious fatigue phenomena.

SUMMARY OF THE INVENTION

It is an object of the present invention to achieve better control over the guidance of the ski without the anatomically natural movements of the legs and joints thereby being impaired. In the support device according to the invention this is achieved in that the support co-operates with a pivot arm arranged outside the ski boot and bridging over at least the flexible parts of the ski boot, which arm is arranged to pivot outwards resiliently in a direction approximately parallel with the ski and transmits the forces from the lower leg upon the support to a hinged joint connectable with the ski. The spring force of the support and preferably also its position can be adapted to the needs of the skier.

An embodiment of the support device according to the invention will be explained in greater detail in the following description with reference to the accompanying drawings.

DESCRIPTION

Figure 1:
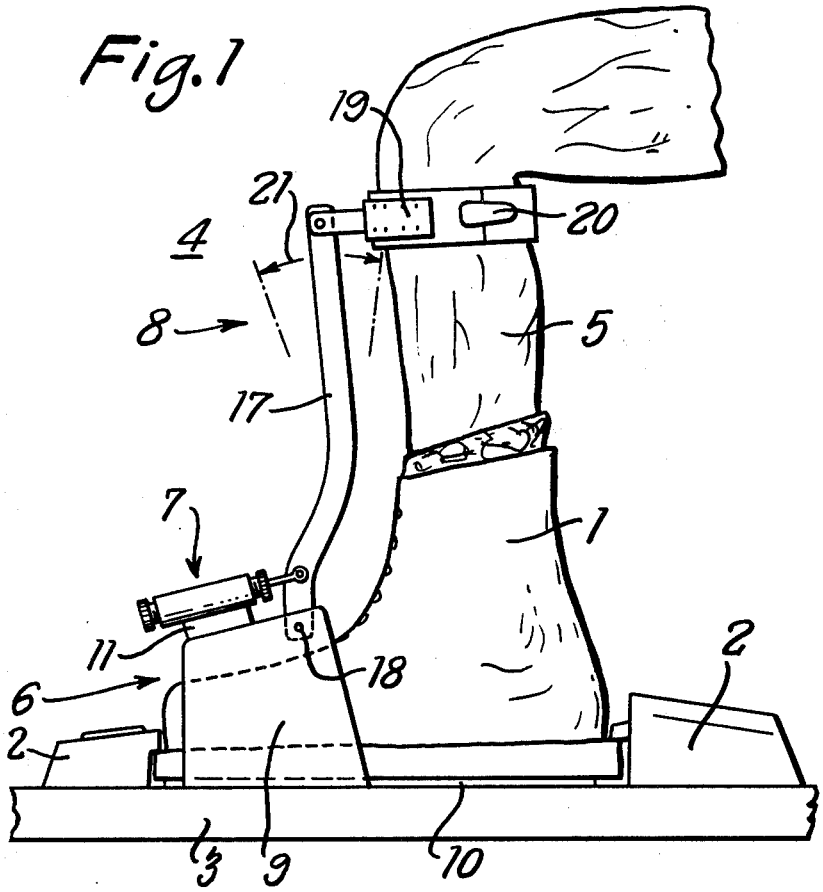
FIG. 1 is a side elevation of a support device on a ski with an under part of metal for ordinary commercial ski boots.
Figure 2:
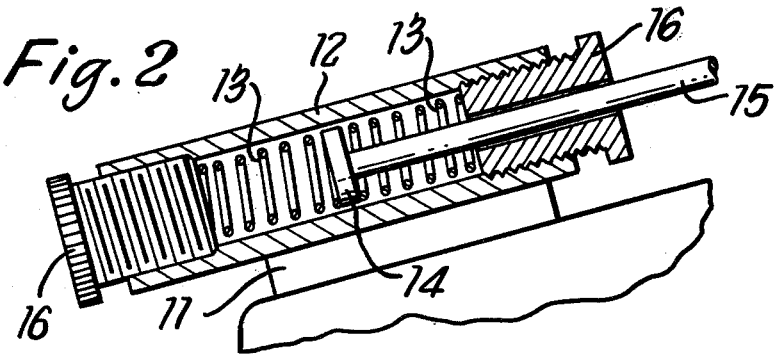
FIG. 2 is a side elevation, partly in section of an adjustable spring device of the support device according to FIG. 1.

In FIG. 1 a ski boot 1 is secured upon a ski 3 by ordinary commercial, safety ski binding 2. A support device 4 serving to improve the support of the skier's lower leg 5 on the ski 3 is pressed firmly upon the ski by the boot 1 through a cup 6 that includes two pairs 9 and is thus firmly connected with the ski. Through a double-acting adjustable spring device 7 the lower part carries a support 8 which is connected with the upper part of the lower leg 5.

The lower part is arranged around the forward region of the ski boot 1 and grasps on both sides by jaws 9. It is firmly connected with the ski 3 by a plate 10 provided below the boot. The two jaws 9 are connected with one another at the top by a crosspiece 11, on which a tube 12 is mounted. Screwed into the ends of the tube 12 are two screws 16, between which lies a piston 14 secured on the end of a push rod 15. The other end of the push rod 15 is articulatedly connected with an upwardly extending pivot arm 17 of the support 8 which is connected at its lower end with the lower part by means of a hinged joint 18. On the upper end of the lever 17, there is mounted a support 19 grasping the leg 5 of the skier a little below the knee. This support can be secured to the leg by a strap 20. The lever 17 and thus, through the support 19, the lower leg 5 of the skier are held in a specific position by the helical springs 13 through the push rod 15 but can move through a certain angle 21 in the range of the two helical springs. Thus spring device 7 resiliently biases movement of arm 17 and hence lower leg 5 of the skier in a direction approximately parallel with ski 3. The spring stress can be increased or diminished by screwing the two screws 16 in or out of the tube 12. The specific position of the lever 17 can be modified by screwing only one or the other of the screws 16 in or out. Thus a very good adjustment of the support device to the user's requirement is possible. In place of springs it is also possible to use rubber buffers which are compressed increasingly for a harder setting, for example, by screws or other devices. By clamping the ski boot between the jaws 2 of the safety binding, the ski boot is pressed firmly with its sole against the ski by the overgrasping jaws 9. The jaws 9 may be provided with dogs which snap directly into the ordinary commercial front and rear jaws of the safety ski binding, the front and rear parts of the boot sole being pressed against the upper surface of the ski by the spring pressure of the binding.

Other embodiments of the invention are clearly possible. A different kind of firm connection between the hinged joint and the ski could comprise a support formed as the jaws of a safety binding and thus secured to the ski. The swivel joint and the pivot arm may be arranged behind the ski boot. The swivel joint and springs could be incorporated in the rigid part of the boot and the firm connection with the ski obtained through the boot sole.

The application of the support device according to the invention not only reduces the risk of injuries, but, moreover, the finely sensitively adjustable support and the exact retention of the lower leg facilitate skiing. Ski guidance is considerably improved by the shifting of the lever action from the heel to the knee joint. Laterally, forwards and rearwards, the skier has more power over the skis and turning is less trouble even under unfavorable snow conditions. The tibia and fibula can move as freely as desired forward and rearward, according to the settng of the spring mechanism. Thus the anatomically natural movement of the legs, which is made impossible by rigid, high-topped, synthetic plastics ski boots, is guaranteed and optimally recovered for alpine sking.

I claim:

1. A leg support device for improved supporting of the lower leg of a skier on a ski and comprising:

connectable lower support means for rigidly connecting said device to the ski in the plane of the ski;

at least one elongated pivot arm;

means for pivotably connecting one end of said pivot arm to said lower support means such that the pivotable connection is located approximately at the height of the ankle joint of the skier;

an upper support means for grasping around at least a part of the lower leg, the other end of said pivot arm being connected to said upper support means and said pivot arm and said lower support means having a length such that said upper support means can grasp around the lower leg in the calf region-thereof; and at least one double action resilient means connected on the one hand to the pivot arm and on the other hand to another part of the leg support device for resiliently biasing said pivot arm back to a neutral position from pivotal movements toward either side of said neutral position.

2. Device as claimed in claim 1, wherein said resilient means comprises a piston axially movable in a cylinder from either side of said neutral position, and spring means on each side of said piston bearing against the closed ends of said cylinder.

3. Device as claimed in claim 2, wherein the ends of said cylinder comprises members threaded into the cylinder and adjustable to vary the force exerted by said spring means on said piston.

4. Device as claimed in claim 1, wherein said lower support means comprises jaws adapted to grasp said ski boot.

5. Device as claimed in claim 1, wherein said pivot arm lies in front of the lower leg of the user and said connecting means pivotally connects said upper support means to the upper end of said arm.

6. Device as claimed in claim 1, wherein the double action resilient means is attached to the pivot arm above said means for pivotally connecting one end thereof to the lower support means.

* * * * *